US006900420B2

(12) United States Patent
Markegård et al.

(10) Patent No.: US 6,900,420 B2
(45) Date of Patent: May 31, 2005

(54) COOLED INDUCTION HEATING COIL

(75) Inventors: Leif Markegård, Skien (NO); Lars Andersson, Vesterås (SE); Risto Säynäväjärvi, Söderkulla (FI); Pekka Höyssä, Vesilahti (FI)

(73) Assignees: Metso Automation Oy, Helsinki (FI); EFD Induction a.s., Skien (NO)

( * ) Notice: Subject to any disclaimer, the term of this patent is extended or adjusted under 35 U.S.C. 154(b) by 0 days.

(21) Appl. No.: 10/451,551

(22) PCT Filed: Dec. 17, 2001

(86) PCT No.: PCT/IB01/02502

§ 371 (c)(1),
(2), (4) Date: Oct. 31, 2003

(87) PCT Pub. No.: WO02/052900

PCT Pub. Date: Jul. 4, 2002

(65) Prior Publication Data

US 2004/0069774 A1 Apr. 15, 2004

(30) Foreign Application Priority Data

Dec. 27, 2000 (FI) ..... 20002862

(51) Int. Cl.[7] ..... H05B 6/42

(52) U.S. Cl. ..... 219/632; 219/670; 219/677; 336/57; 100/92; 100/328

(58) Field of Search ..... 219/632, 677, 219/670, 635, 619, 674, 675; 336/57, 58, 61, 62; 100/310, 312, 328, 318

(56) References Cited

U.S. PATENT DOCUMENTS

| | | | | |
|---|---|---|---|---|
| 3,946,349 A | | 3/1976 | Haldeman, III | 336/62 |
| 4,317,979 A | * | 3/1982 | Frank et al. | 219/665 |
| 5,003,145 A | * | 3/1991 | Nolle et al. | 219/632 |
| 5,101,086 A | | 3/1992 | Dion et al. | 219/10.491 |
| 5,313,037 A | | 5/1994 | Hansen et al. | 219/632 |
| 5,461,215 A | | 10/1995 | Haldeman | 219/677 |

* cited by examiner

*Primary Examiner*—Philip H. Leung
(74) *Attorney, Agent, or Firm*—Steinberg & Raskin, P.C.

(57) ABSTRACT

The present invention relates to an induction heating coil comprising a litz cable which is wound into a spiral to form a bobbin, and means for cooling said cable indirectly. The litz cable is arranged to be cooled by means of an indirect cooling system that comprises a tube which is wound in an intermeshed fashion with the windings of the litz cable. The present invention relates also to a method on a paper or board machine or on a paper finishing machine, in which method at least one induction heating coil comprising a wound litz cable is used for heating a component, and said coil is cooled indirectly by a cooling medium.

12 Claims, 2 Drawing Sheets

Section A-A

COOLED INDUCTION HEATING COIL

FIELD OF THE INVENTION

The present invention relates to an induction heating coil comprising a litz cable that is cooled. The litz cable is composed of many thin, mutually electrically insulated, and revolved copper threads. In the induction heating coil, the litz cable is wound into a spiral shape to form windings of a bobbin in the induction heating coil. The present invention relates also to a method on a paper or board machine or on a paper finishing machine.

BACKGROUND OF THE INVENTION

An induction heating coil normally comprises a core and a cable or a tube that is wound around the core. Typically, the core is of ferrite or laminated iron, and the material of the cable or the tube includes copper. It is possible to use the induction heating coil without the core, but particularly when the coil does not circumfere the component, the core improves the magnetic coupling to the component drastically.

In induction heating, an alternating current from an electric power source creates an alternating magnetic field. The alternating magnetic field induces eddy currents that heat a component. The magnetic field is arranged to alternate at a certain controllable frequency, and this frequency of the magnetic field determines the penetration depth of the induction heating into the component. The higher the frequency is, the lower is the penetration depth. To obtain the desired heating effect, the component must be an electric conductor. If the component includes ferromagnetic material, such as iron, cobalt, nickel, or their alloys, the penetration depth is reduced and the component acts as a higher resistance load. This helps to increase the efficiency of the induction coil.

The efficiency of the heating depends, among other things, on the electric losses in the coil. The use of litz cables as coil windings instead of hollow, water-cooled copper tubes has the advantage of low coil losses. A litz cable can be wound in several layers without producing excessive losses due to the fine threads of the litz cable that have a diameter smaller than the penetration depth of copper at the actual frequency. In contrast to a bobbin made of a hollow copper tube that has to be wound in one layer only to avoid excessive losses, a litz cable bobbin can be made with a large turn number and a larger effective copper area and thus reduced copper losses. However, to reach a desired power in a litz cable coil, the losses in the winding and core is normally at a level that requires forced cooling to protect the insulation material of the core, or the cable forming a bobbin, from over-heating.

Coils comprising litz cables are discussed e.g. in U.S. Pat. No. 5,101,086 and U.S. Pat. No. 5,461,215. U.S. Pat. No. 5,101,086 deals with coils in a frequency range from 12 to 25 kHz and discloses an electromagnetic inductor with a ferrite core for heating electrically conducting material. The electromagnetic inductor includes a litz cable and a water cooled magnetic flux concentrator tube which is arranged to circulate water and cool indirectly a coil wound of the litz cable. The cooling concentrator tube is disposed around the coil and insulated from it with a synthetic resin. The electromagnetic inductor is utilised for instance on calenders.

The inductor with concentrators acts as a combined transformer and coil. The litz cable winding is the primary winding. The concentrator is a combined one-turn secondary and a one-turn coil. The inductor can have a high input impedance because of the high turn number possible in the primary litz cable winding, but the losses will be on the level of a coil made of a hollow copper tube and thus several times as high as in a pure litz cable coil. This will have a significant influence on the efficiency of the coil, even if the component is of ferromagnetic material.

The publication U.S. Pat. No. 5,461,215 discloses a litz cable surrounded by a coolant tube. A fluid for removing heat generated by the litz cable is conveyed through an annular space between the litz cable and the coolant tube. The coolant is thus in direct contact with the litz cable. This publication deals with high current litz cables whose diameters vary from 9.5 mm to 14 mm. The current varies from 700 to 1000 A, and the frequency is 300 kHz.

The induction heating coils comprising litz cables which include a cooling system are rather complicated. In addition, the coolant tubes having cooling medium flowing inside them and around the litz cables within the coolant tubes have large diameters. The large diameter causes restrictions on the number of windings and thus the power is not achieved when the current is limited. If the diameter of the cable is reduced, the amount of copper in each thin, electrically insulated thread is reduced and thus energy losses increase. Due to the greater losses, more heat is generated and thus more cooling is required. Better cooling necessitates greater fluid volume, or the current density must be limited to a level at which the prevailing cooling is adequate. Furthermore, the cables with large diameters have restrictions on bending, e.g. they cannot be wound around a core with a small diameter.

OBJECTS AND SUMMARY OF THE INVENTION

The above-mentioned drawbacks can be reduced or avoided by using an induction-heating coil of the invention. The coil of the invention is characterised in that the litz cable is arranged to be cooled by means of an indirect cooling system that comprises a tube that is wound in an intermeshed fashion with the windings of the litz cable. The method of the invention is characterised in that the induction heating coil is cooled by a cooling medium which is circulated in a tube which is wound in an intermeshed fashion with the windings of the litz cable.

In this application the term indirect means that the cooling medium is not in direct contact with the litz cable. The term intermeshed means in this context that the tube conveying the cooling medium is wound in the same manner as the litz cable and the windings of the tube are among the windings of the litz cable in direct contact or in close proximity to the outer surface of the litz cable. The number of the windings of the tube does not depend on the number of the windings of the litz cable.

Advantages of the coil of the invention include e.g. that

- the coil is compact,
- the cooling circuit of the coil is electrically separated from the coil,
- the cooling circuit is well distributed among the windings of the litz cable, and
- the coil of the invention could be used highly efficiently in high turn, low current coils in which the current is typically from 10 to 100 A.

When the coil of the invention and the coil described in U.S. Pat. No. 5,101,086 are compared, the coil of the invention has several advantages. The cooling circuit of the coil of the invention is distributed among the windings that means shorter distances to conduct the heat losses as well as greater heat conducting surface. The simple structure of the cooling circuit also prevents additional losses due to a complex structure of the cooling arrangement and thus enhances the coil efficiency.

A basis for a layout of the induction coils is that a certain number of ampere-turns must be achieved by using bobbins with a small diameter. The number of windings that are needed in the bobbins depends on the current. When a coil is connected directly (without a transformer) to a power source, the current is predetermined by power.

The litz cable forms generally multiple windings. The litz cable can be wound around a ferrite core or it can be wound without the core as well. To overcome the limitations (discussed above in connection with the prior art) to use litz cables in induction heating coils, a well distributed indirect cooling of the litz cable has been invented. The induction heating coil of the invention comprises the litz cable and an indirect cooling system. The indirect cooling system includes a cooling medium which flows in a tube. The litz cable is placed outside, in close proximity of the tube, so that the heat generated in the litz cable is removed through the walls of the litz cable and the tube to the cooling medium. The tube is wound in the same manner as the litz cable, forming a spiral which intermeshes with the spiral formed of the litz cable. The cross section of the tube may be for example a circle or a square. The shape of the cross section should be adjusted according to the needs of compact packing of the coil and/or effective cooling of the litz cable. The contact area between the tube and the litz cable is important in view of the cooling efficiency. The larger the contact area between the litz cable and the tube is, the more efficient is the cooling. The tube is preferably a hose of flexible, chemically resistant plastic material which conducts heat and is an electric insulator. The heat transfer through the wall of the tube limits the cooling capacity of the cooling medium inside the tube. The cooling medium is preferably water, but also other suitable fluids or gases are possible, for example oil or liquid nitrogen can be used.

The induction heating coil of the invention can be used to heat electrically conductive materials, preferably ferromagnetic materials. It can be used for example in heated systems on paper or board machines or the like or on paper finishing machines. Such heated systems include, among others, rotating heated calender rolls. The calender rolls may be heated merely by induction heating coils, or the induction heating coils can be used as auxiliary heaters. The calender rolls can also be heated by multiple induction heating coils, and in this case it is possible to adjust the temperature profile over the whole roll length, by adjusting the coil currents.

BRIEF DESCRIPTION OF THE DRAWINGS

In the following, the invention will be described by means of the appended drawings.

In the drawings.

DETAILED DESCRIPTION OF THE INVENTION

Figure 1:
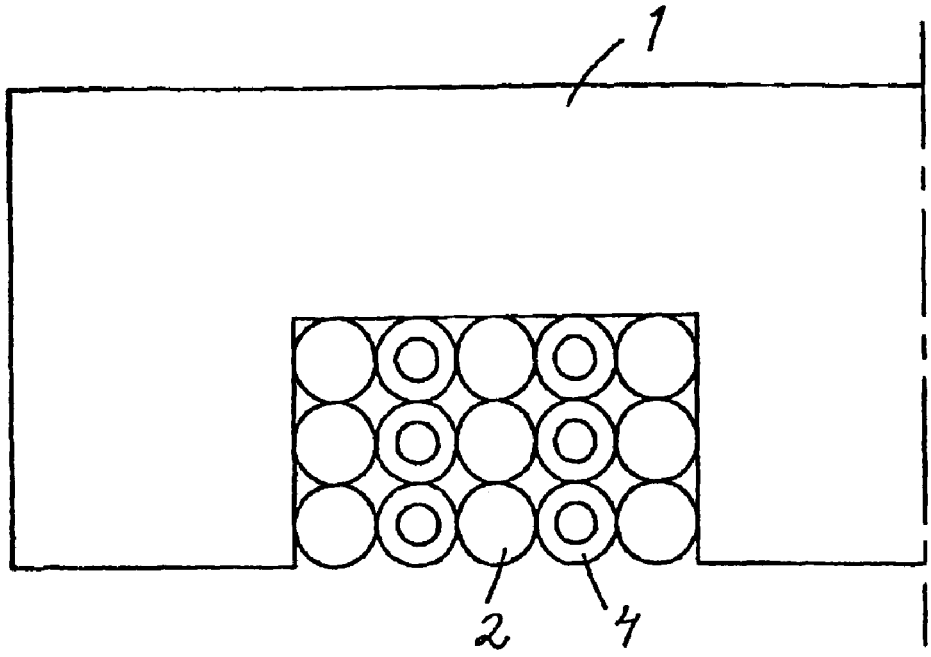
FIG. 1 shows a cross section of an induction heating coil of the invention.

FIG. 1 shows an embodiment of the invention, in which the induction heating system includes a ferrite core 1 and a litz cable 2. The litz cable is wound several times around the ferrite core. The required number of windings depends on the desired heating effect. The induction heating bobbin comprises a litz cable 2 and a cooling tube 4 preferably in such a manner that the litz cable contacts the outer surface of the tube 4 conveying cooling medium, such as water. The cooling medium is thus isolated from the litz cable. The number of windings of the tube does not have to be equal to the number of windings of the litz cable. The number of the windings of the tube only depends on the needed efficiency in cooling. The higher the desired current is, the greater is the number of the windings. The induction heating coil illustrated in the FIG. 1 comprises two symmetrical halves and thus only one half of the coil is drawn.

Figure 2A:
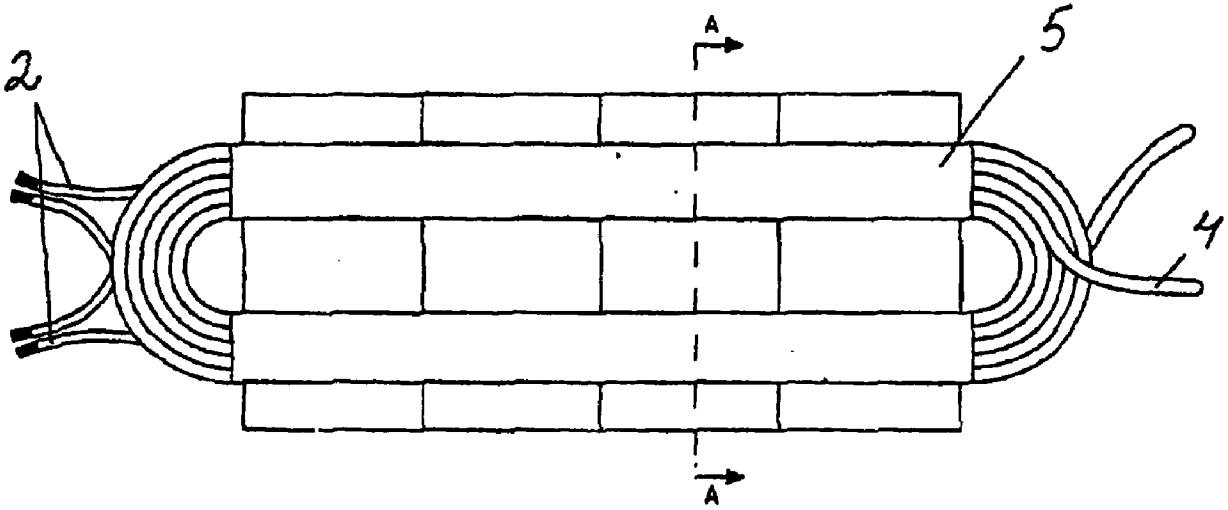
FIG. 2*a* shows a top view of an induction heating coil of the invention.
Figure 2B:
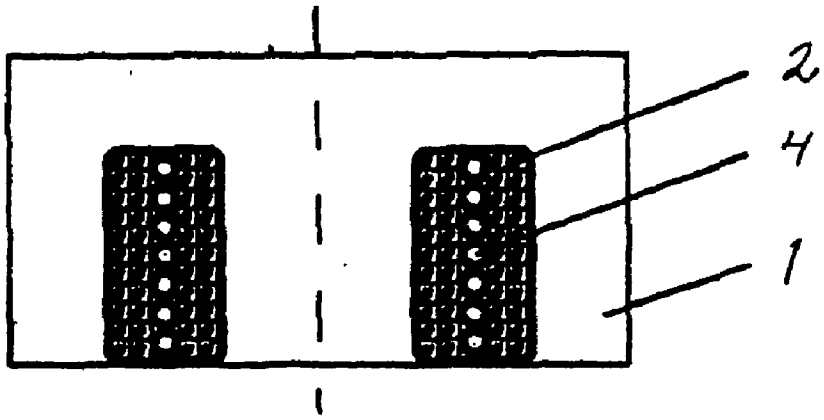
FIG. 2*b* shows a cross-sectional view of the induction heating coil in FIG. 2*a*.

FIG. 2*a* shows a top view of another induction heating coil of the invention, and FIG. 2*b* shows a cross-sectional view of the same induction heating coil. An induction heating bobbin includes electric insulation 5 against a ferrite core 1. The material of the cooling tube 4 is polytetrafluoroethylene (PTFE), which is well resistant to heat and to liquids and conducts heat. In the figure, the tube 4 has seven windings, and the litz cable 2 has 21 windings. The inner diameter of the tube 4 is 2 mm and the outer diameter is 3 mm. The cross-sectional area of the litz cable is 2 $mm^2$.

EXAMPLE

A winding for 25 A/18 kHz and 34 turns was implemented within a window 10×20 $mm^2$ with a minimum bending radius of 17 mm. A litz cable, whose cross section was square-shaped and its cross-sectional area was 2 $mm^2$, was used. The number of the windings of the litz cable was 34, and the number of the windings of the tube conveying the cooling medium was 10. The inner diameter of the tube was 2 mm and the outer diameter was 3 mm. The windings of the tube were intermeshed with the windings of the induction bobbin.

When prior art cooling systems which include a litz cable inside a coolant tube are used, the outer diameter of the system should be at least 5 mm and thus the inner diameter of the coolant tube is 3.8 mm. To fit the system to the same window 10×20 $mm^2$, the maximum number of windings should be 10 (2×5). In addition, to achieve the proper bending radius, the coolant tube should be preformed to enhance the winding. As can be seen, the system of the invention is far more effective than systems of the prior art when the current is predetermined by the power.

The above-described facts do not restrict the embodiments of the invention, but the embodiments may vary within the scope of the claims. The main aspect of the invention is that the induction heating coil can be cooled by an indirect cooling system which has many advantages compared to the induction heating coils of the prior art.

What is claimed is:

1. An induction heating coil comprising a litz cable which is wound into a spiral to form a bobbin, and means for cooling said cable indirectly, wherein the litz cable is arranged to be cooled by means of an indirect cooling system that comprises a tube formed of electrically insulated material, which is wound in an intermeshed fashion with the windings of the litz cable, and wherein said tube is disposed among said litz cable.

2. The coil according to the claim 1, wherein a cooling medium is arranged to flow in the tube.

3. The coil according to the claim 2, wherein the cooling medium is water, oil or liquid nitrogen.

4. The coil according to any of the preceding claims 1, wherein the tube includes plastic material.

5. The coil according to the claim 1, wherein the coil is arranged to heat a component of a paper or board machine or a paper finishing machine.

6. The method according to the claim 5, wherein the component is a rotating roll in contact with a paper or board web.

7. The method according to the claim 6, wherein the rotating roll is a calender roll.

8. A method on a paper or board machine or on a paper finishing machine, in which method at least one induction heating coil comprising a wound litz cable is used for heating a component, and said coil is cooled indirectly by a cooling medium, wherein the induction heating coil is cooled by a cooling medium which is circulated in a tube formed of electrically insulated material, which is wound in an intermeshed fashion with the windings of the litz cable, and wherein said tube is disposed among said litz cable.

9. The method according to the claim 8, wherein the cooling medium is water, oil or liquid nitrogen.

10. The method according to the claim 8, wherein the coil heats the component of a paper or board machine or a paper finishing machine.

11. The method according to the claim 10, wherein the component is a rotating roll in contact with a paper or board web.

12. The method according to the claim 11, wherein the rotating roll is a calender roll.

* * * * *